US006435911B1

(12) United States Patent
Payson et al.

(10) Patent No.: US 6,435,911 B1
(45) Date of Patent: Aug. 20, 2002

(54) DATA SIGNAL CONNECTOR WITH PROTECTIVE OVERMOLD

(75) Inventors: Brian D. Payson, Bolton, MA (US); Mark E. Fillion, Rumford, RI (US); Robert K. Neagle, Lake in the Hills; Bradley E. Woodman, Evanston, both of IL (US)

(73) Assignee: Woodhead Industries, Inc., Deerfield, IL (US)

( * ) Notice: Subject to any disclaimer, the term of this patent is extended or adjusted under 35 U.S.C. 154(b) by 0 days.

(21) Appl. No.: 09/660,051

(22) Filed: Sep. 12, 2000

Related U.S. Application Data

(60) Provisional application No. 60/153,573, filed on Sep. 13, 1999.

(51) Int. Cl.[7] ..... H01R 13/58

(52) U.S. Cl. ..... 439/606; 439/676; 439/344; 439/320

(58) Field of Search ..... 439/676, 606, 439/344, 447, 604, 445, 571, 572, 551, 550, 320, 747

(56) References Cited

U.S. PATENT DOCUMENTS

| | | | | | |
|---|---|---|---|---|---|
| 3,613,048 | A | * | 10/1971 | Brundza | 439/275 |
| 3,816,641 | A | * | 6/1974 | Iversen | 174/76 |
| 3,998,515 | A | * | 12/1976 | Panek | 439/198 |
| 4,703,989 | A | * | 11/1987 | Price et al. | 439/238 |
| 4,769,906 | A | * | 9/1988 | Purpura | 29/857 |
| 5,378,882 | A | | 1/1995 | Gong et al. | 235/472 |
| 5,462,457 | A | | 10/1995 | Schroepfer et al. | 439/736 |
| 5,803,770 | A | | 9/1998 | Swendson et al. | 439/676 |
| 6,171,136 | B1 | * | 1/2001 | Liu et al. | 439/466 |

* cited by examiner

*Primary Examiner*—P. Austin Bradley
*Assistant Examiner*—Ross Gushi
(74) *Attorney, Agent, or Firm*—Emrich & Dithmar

(57) ABSTRACT

Embodiments of industrial data signal connectors are disclosed. A male connector assembly includes a rigid core mold partially encompassing the housing of male data signal connectors such as the RJ45 and USB connectors, and a flexible overmold for protection and strain relief. Assemblies for the corresponding female RJ45 and USB connectors suitable for industrial applications are also disclosed.

16 Claims, 8 Drawing Sheets

DATA SIGNAL CONNECTOR WITH PROTECTIVE OVERMOLD

RELATED APPLICATION

This application claims priority of co-pending, co-owned provisional application Serial No. 60/153,573, filed Sep. 13, 1999.

FIELD OF THE INVENTION

The present invention relates to electrical connectors; and more particularly, the invention relates to electrical connectors of the type used to connect conductive leads intended to carry electrical data signals, as distinguished from connectors designed to carry, for example, electrical power. Of particular interest are electrical data signal connectors of the type widely used to interface with the "Ethernet" communications network and the Universal Serial Bus (USB) connector, both of which are in widespread use in offices and other sites, but not in industrial applications such as manufacturing plants. These connectors are characterized as having a plurality of connector elements arranged side-by-side and parallel to one another, as in the case of Ethernet, or in a rectangular pattern for the US connector. Hence, the connector elements are arranged in a line or plane transverse of the direction of elongation of the associated conductor leads, and these types of connectors are referred to herein as data signal connectors.

BACKGROUND AND SUMMARY OF THE INVENTION

Conventional data signal connectors of the type described above and in connection with which the present invention is concerned, are not manufactured to meet the more rigorous conditions of use normally found in industrial applications—that is, for use in factories and other manufacturing facilities. Typically, such data signal connectors are used in residential, office, or other commercial applications where they were not normally subjected to being twisted, pulled and stepped on, as might typically occur in an industrial environment, such as an automated manufacturing facility. As the use of electronics and computer-centered automation control systems have entered the manufacturing environment, the use of office communications networks has greatly expanded into the workplace. This has created a need for a more industrialized data signal connector for communications networks, capable of meeting the standard electrical specifications for existing non-industrial data signal connectors, yet rugged enough to withstand the rigors of an industrial environment.

The present invention is illustrated in the context of two widely used and accepted multiple-lead connectors known as an RJ45 connector and a Universal Serial Bus (USB) connector. RJ45 connectors are well known in the industry and used in Ethernet networks. These connectors have been used widely for connecting multiple-lead cable assemblies to equipment, specifically to printed circuit boards mounted within equipment cabinets. RJ45 connectors are used for parallel data bus systems. US connectors are also well known for non-industrial serial data transmission networks and systems.

The present invention provides a partial sub-mold or core mold formed directly around a portion of the body of the data signal connector, but free of the contact elements. The core mold may have general circular symmetry, and its purpose is to provide a rigid housing for and mechanical stability to the insulating body or casing of the data signal connector. The core mold forms a flange for receiving a threaded coupling nut and it also extends over the insulating jacket of a multiple-lead cable, the leads of which are connected to the individual contact elements of the data signal connector.

An insulating, flexible overmold is then formed about the cable and the proximal portion of the core mold. The overmold provides a seal as well as further mechanical strength and stability and strain relief to the region of joinder between the cable and the core mold to reduce the stress or strain that might otherwise be transmitted to the juncture between the leads and the electrical contacts. Thus, the protective core mold and overmold provide greater strength, reliability and protection for data signal connectors, and permit the conventional, non-industrialized data signal connector and multiple lead cable assembly to possess the ruggedness and reliability required for industrial use.

Other features and advantages of the present invention will be apparent to persons skilled in the art from the following detailed disclosure of the preferred embodiment accompanied by the attached drawing where identical reference numerals will refer to like parts in the various views.

DETAILED DESCRIPTION OF THE ILLUSTRATED EMBODIMENTS

Figure 1:
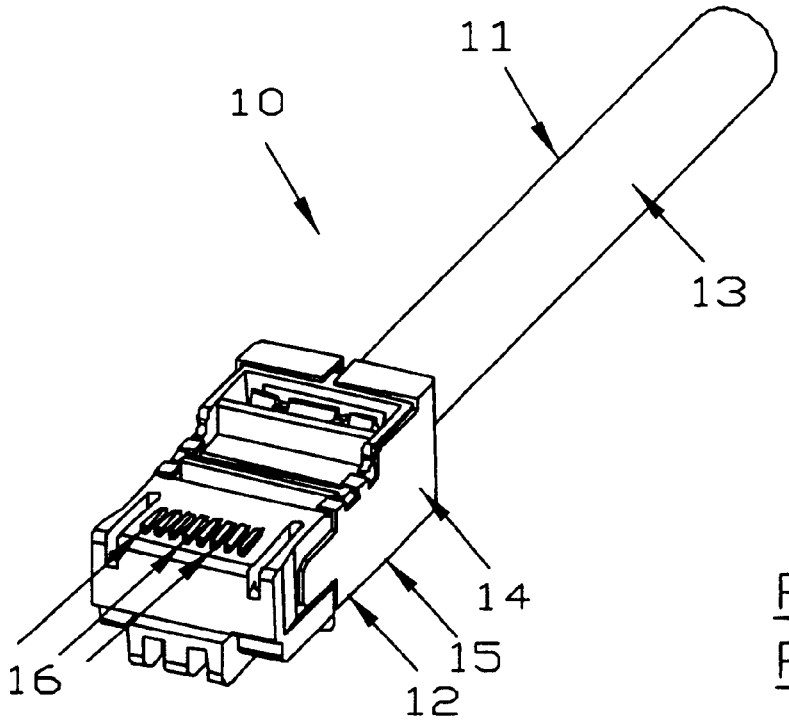
FIG. 1 PRIOR ART
FIG. 1 is an upper, frontal perspective view of a male data signal connector and cable assembly which is known in the art.

Turning first to FIG. 1, reference numeral 10 generally designates a cable assembly including a cable 11 and a male data signal connector generally designated 12. As shown, the cable assembly is a standard assembly, available commercially in the form shown. The cable 11 meets IEA standards and is known as a Category-5 cable having a plurality of insulated leads (typically, eight leads) and is provided with an outer sheath 13 which may, depending upon the application, be polyurethane in order to provide increased resistance to oil and gas.

Figure 2:
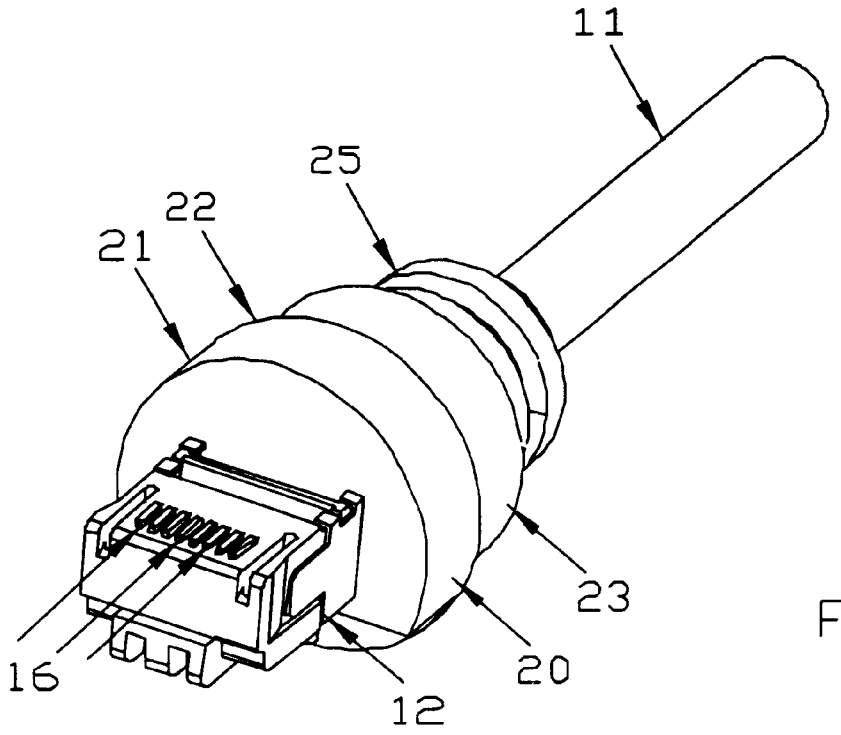
FIG. 2 is an upper, frontal perspective view of the cable assembly of FIG. 1 provided with a circumferential core mold according to the present invention.

The male connector includes an insulating base or casing 14 of standard construction and including a flexible locking tab 15, for purposes to be later described. A plurality (again, eight) of electrical contact elements 16 are mounted in the base 14 in lateral alignment, as seen in FIGS. 1 and 2.

The eight electrical contact elements 16 are similar in shape, in that they are mounted in side-by-side relation, electrically insulated from one another and spaced to form an in-line construction when viewed from the side. That is, the contact elements 16 are aligned, one behind the other when viewed along a plane perpendicular to the direction of extension of the cable 11. As used herein, "front" or "distal" refer to the connection end of the connectors and "rear" or "proximal" refer to the cable end.

The male connector 12 is also commercially available individually. It meets the standards set by AT&T for an RJ45 connector, and it is understood to be licensed by AT&T throughout the communications network industry, primarily for residential, personal, office and light commercial applications, such as data processing or inter-office communications usage.

The assembly of FIG. 1 and the connector 12 as shown are not suitable for use in industrial environments because the connection between the leads of the cable 11 and the contact elements 16 of the connector 12 cannot withstand the rigors of use in an industrial environment. Moreover, the insulating base or housing 14 has insufficient resistance to crushing force, and it fractures or breaks under moderate force. In order to strengthen the interface between the cable 11 and the connector 12 and to protect the connector itself against forces tending to crush it, a sub-mold designated generally by reference numeral 20 in FIG. 2 and referred to as the core mold is molded about the juncture between the rear end of the connector 12 and the adjacent end of the cable 11, at least partially covering and encompassing the base 14 of the connector 12.

The core mold 20 (see FIGS. 7 and 8 also) is an integral body which is injection molded about the assembly of FIG. 1 and particularly covering the juncture between the cable 11 and the rear of the connector and encompassing the rear portion of connector housing 14. The core mold 20 forms a forward disc-shaped portion 21 behind which is located a second cylindrical portion 23 of smaller diameter than the forward disc-shaped portion 21 to provide a step or wall 22. Wall 22 acts as a retainer wall or shoulder for an internally threaded coupling nut designated 24 in FIG. 4. The forward disc portion 21 of the core mold is slightly enlarged further to surround and protect the rear or proximal portion of the connector housing 14.

Figure 7:
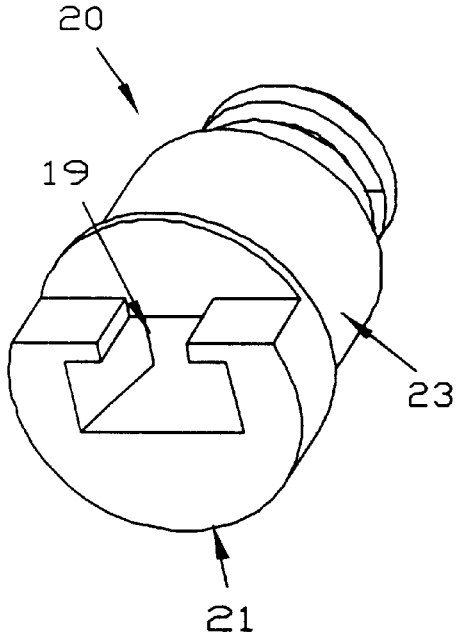
FIG. 7 is a perspective view showing the underside core mold shown in FIG. 3.

The core mold 20 is formed about the connector assembly of FIG. 1 and becomes an integral part of it. The core mold 20 is formed so that the forward disc 21 defines a recess designated 19 in FIG. 7 for access to the lock tab 15 of the data signal connector 12 in the final assembly. It will be understood that the access recess 19 normally faces down because the normal orientation of the data signal connector is as shown in FIG. 1 and the orientation of FIGS. 7 and 8 are for purposes of illustration.

Figure 3:
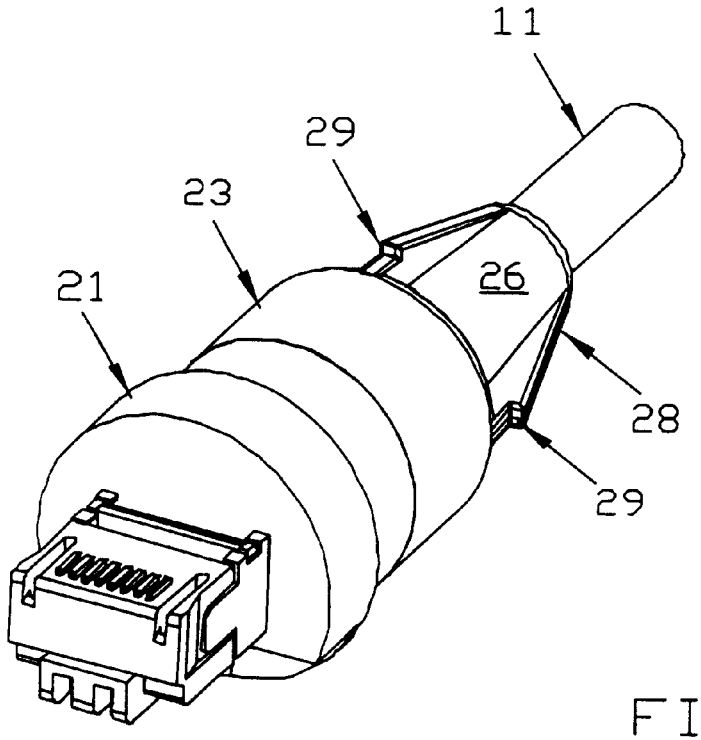
FIG. 3 is a view similar to FIG. 2 with an injected overmold partially surrounding the core mold and the cable of the assembly of FIG. 2.
Figure 8:
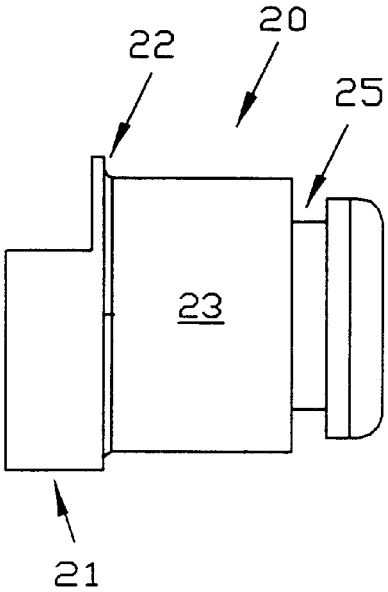
FIG. 8 is a side elevational view of the core mold of FIG. 7.
Figure 9:
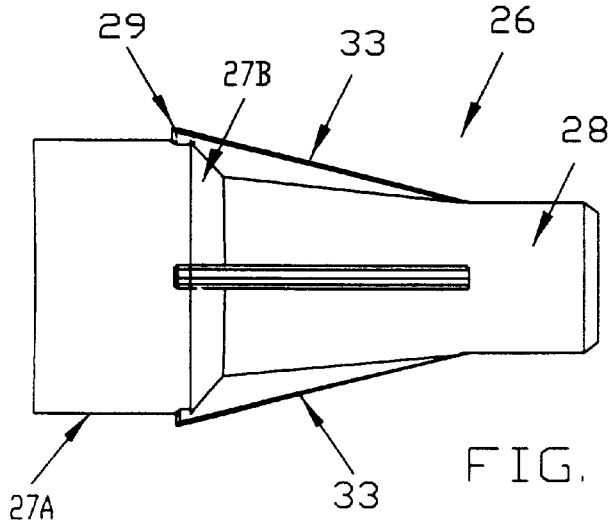
FIG. 9 is a side elevational view of the protective overmold shown in FIG. 4.

Toward the rear of the core mold 20, and surrounding the cable 11 is an extension providing an interconnect structure including a peripheral recess or groove designated 25 in FIGS. 2 and 8. The purpose of the interconnect structure and recess 25 is to provide a mechanical coupling between the core mold 20 and an overmold shown at 26 in FIGS. 3 and 9. The overmold 26 is formed by injection; and it may be made of any suitable flexible thermoplastic elastomer such as polyurethane. The overmold 26 has a larger diameter at its forward end 27, which is, however, preferably slightly smaller than (but no larger than) the diameter of the rear cylindrical portion 23 of the core mold 20, in order to provide travel to the shoulder or wall 22 for the coupling nut 24, as will become clear. The overmold 26 includes a front cylindrical portion 27A, a forward tapered section 27B leading to an elongated tapered body portion designated 28, which reduces until it eventually is slightly larger than the diameter of the cable 11, and its rear end. Formed in the overmold body 26 are a plurality of flexible ears or barbs 29 spaced rearwardly from the cylindrical portion 23 of the core mold 20 and to the rear of the cylindrical portion 27A of the overmold 26. The cylindrical walls 23 of the core mold and 27A of the overmold 26 are substantially the same size, which fits through the rear aperture in the coupling nut 24. The barbs 29 project out to restrain further rearward movement of the coupling nut. Toward the rear of cylindrical portion 27A of the overmold, a frusto-conical surface 27B tapers to the longer tapered body portion 28. A plurality (four in the illustrated embodiment) of ribs 33 extend from behind the barbs 29, along the first tapered wall 27B and a portion of the longer tapered body portion 28, as best seen in FIG. 9. The core mold 20 is made from a rigid plastic such as ABS, and the overmold 26 is made of a softer, more flexible material such as polyurethane.

Figure 4:
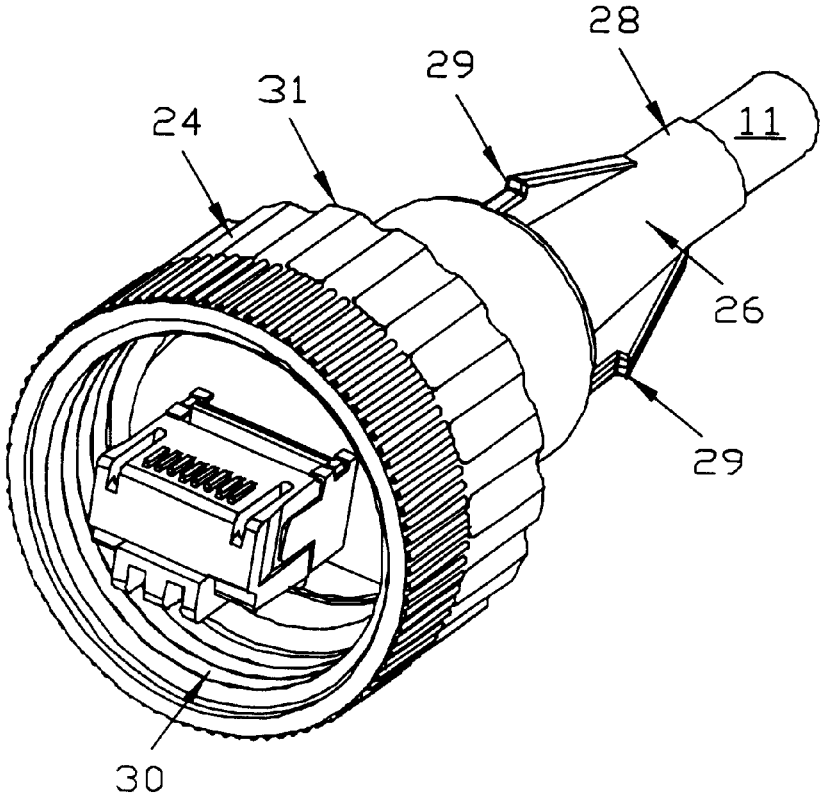
FIG. 4 is a view similar to FIG. 3 with an internally threaded coupling nut added.

Turning now to FIG. 4, the coupling nut 24 is internally threaded at 30, and it includes a rear wall 31 which is annular in shape and has a central opening for fitting over the cable 11, and the tapered portions 28 and 27A, ribs 33 of the overmold 26, and the ears or barbs 29 to engage the retaining wall 22 of the collar or disc-shaped portion 21 of core mold 20. The ears 29 are compressed during assembly of the coupling nut 24, but they assume their original position after assembly and act to hold the coupling nut onto the assembly. An O-ring may be located between the rear wall 31 of the coupling nut 24 and the wall 22 of the core mold 20.

What has been described in connection with FIGS. 1–4 is a male industrial data signal connector adapted for use in applications exposing the connector to a more rigorous use environment. There is also a need to strengthen and protect the corresponding female data signal connector. Typically, in an industrial setting, the female connector is mounted to a panel which may be a part of a metal cabinet housing electronic hardware. Two such industrial female data signal connectors will now be described. The first is described in connection with FIGS. 10–13, and a second, which is very similar to the first, is referred to as a pass-through connector and illustrated in FIGS. 14–16.

Figure 5:
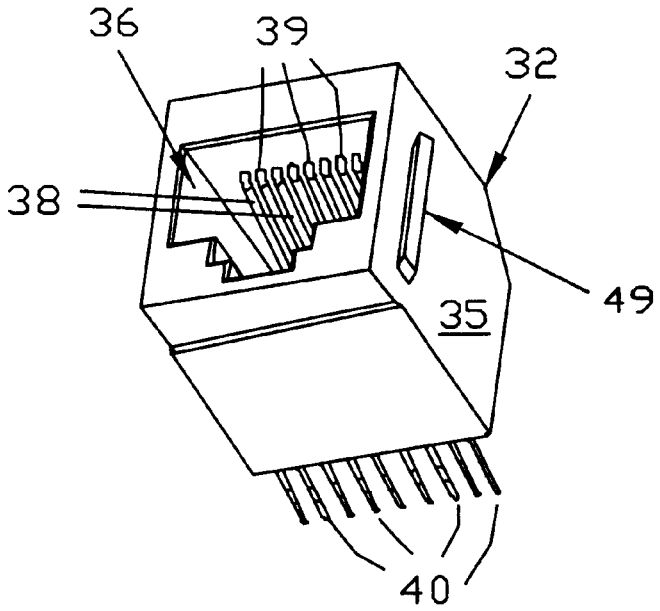
FIG. 5 PRIOR ART
FIG. 5 is a lower, frontal perspective view of a female data signal connector adapted to be mounted to a printed circuit board.

In FIG. 5 there is shown a female electrical data signal connector 32 meeting the RJ45 specifications. The female data signal connector of FIG. 5 includes an insulating connector body or casing 35 which may be molded which defines a receptacle or opening 36 for receiving the nose or front end of the male connector 12, previously described and establishing electrical continuity with its connecting elements. The female connector 32 is of a style adapted for surface mounting to a printed circuit board, and it also is commercially available. Included within the female connector body 35 are a plurality of contact elements (again, eight in number) designated 38. Each of the contact elements 38 has a first portion 39 located in the upper portion of the receptacle 36 and adapted to engage the upper surface of the male contact elements 16 of FIG. 1 when the male and female connectors are assembled. The contact elements 38 extend rearwardly through the connector body 35, and downwardly to form tines or "wipes" as they are sometimes referred to, and designated by reference numeral 40 in FIGS. 5 and 6. The wipes 40 are designed to engage under spring tension, a corresponding lead designated 41 and deposited on the surface of the printed circuit board or card or other medium designated 42. That is, the female connector body 35 is mounted to the printed circuit board 42 such that each of the wipes 40 engage and establish electrical contact with a corresponding conductor lead 41 on the printed circuit board (or other carrier medium).

Figure 6:
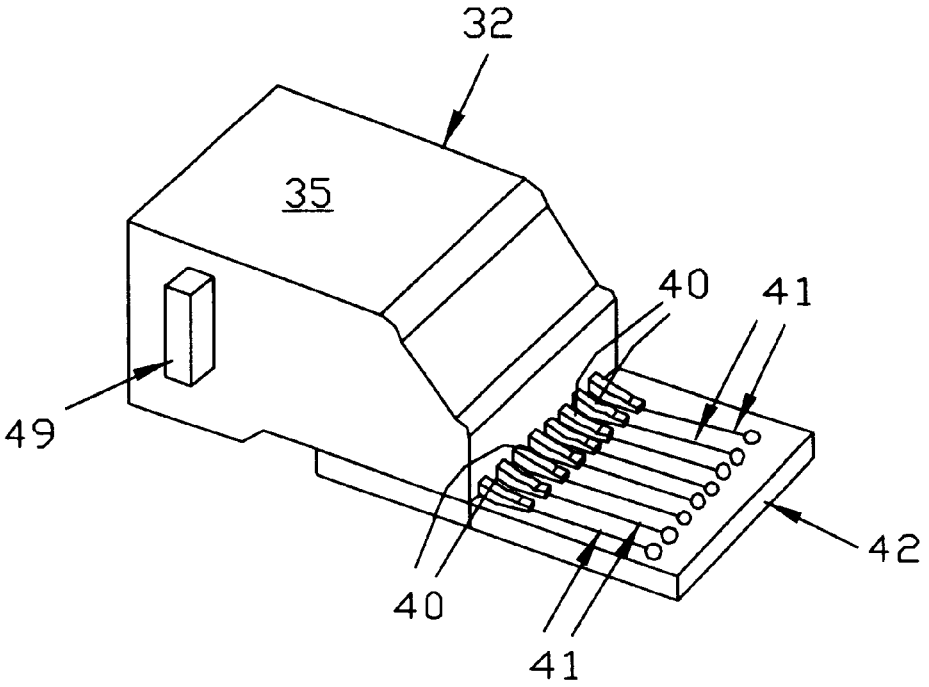
FIG. 6 PRIOR ART
FIG. 6 is an upper, rear perspective view of the female data signal multiple connector of FIG. 5 including a printed circuit board.

Turning to FIGS. 10–13, a molded housing 44 includes an annular rib 45 and forward and rear externally threaded necks or extensions 46, 46A. The molded housing 44 defines a central passage or opening 47 which extends completely through the housing 44, defining at its front end, an aperture 48 adapted to receive the nose or leading portion of the male connector 12, and at its rear end an aperture 49 adapted to receive a female data signal connector 32, as seen in FIGS. 5 and 6, for permanent mounting. The molded housing 44 may be formed from any engineering grade resin suitable for the application. The housing 44 may be fixed to the housing 35 of the female data signal connector 32 and secured by epoxy or other resin, or it may be ultrasonically welded, or secured by any other suitable means to the female connector housing 35 with the opening 47 of the molded housing 44 aligned with the receptacle 36 of the female connector. Alignment keys, one of which is shown at 49 in FIGS. 5 and 6 are formed on the sides of the connector body 35. The keys are received in ways 50 formed in interior side walls of the opening 47 of housing 44 to align the receptacle 36 within the opening 47.

Figure 10:
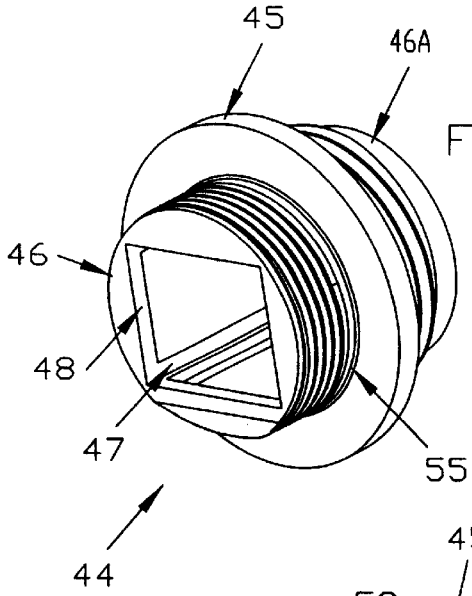
FIG. 10 is a front perspective view of a panel mount casing for a data signal connector.
Figure 11:
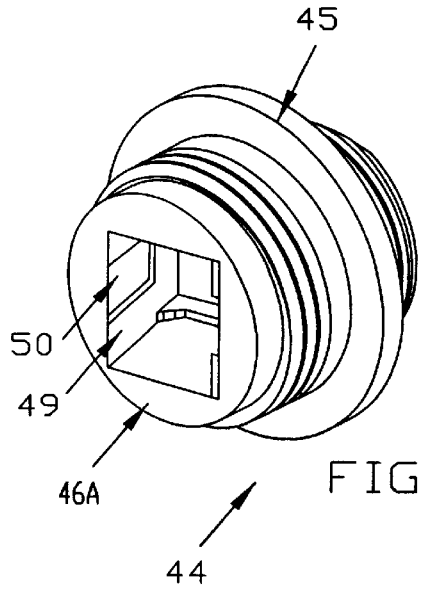
FIG. 11 is a rear perspective view of the casing of FIG. 10.
Figure 12:
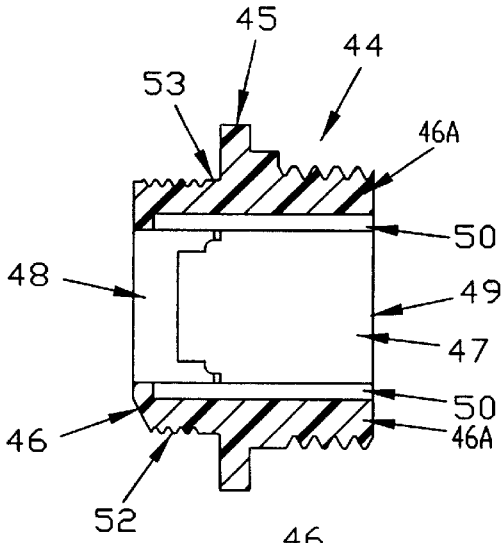
FIG. 12 is a horizontal longitudinal cross sectional view of the panel mount casing of FIGS. 10 and 11 taken through the site line 12—12 of FIG. 13.
Figure 13:
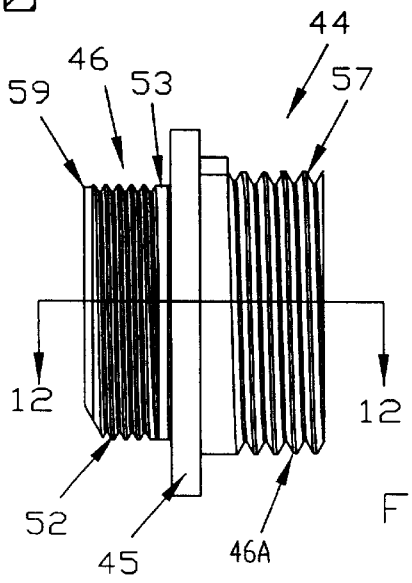
FIG. 13 is a side view of the panel mount casing of FIGS. 10 and 11.

Referring particularly to FIGS. 12 and 13, the threads on the front extension 46 are designated 52, and it can be seen that they terminate forward of the front surface of the annular ridge 45 to provide an annular recess 53 which receives a sealing O-ring, designated 55 in FIG. 10. The threads on the rear extension 46A, designated 57 in FIG. 13, are adapted to receive a conventional electrical mounting nut behind the panel through which the rear extension 46A is passed. The rear surface of the annular rim 45 engages the front surface of the panel to which the unit is being mounted, and the electrical nut engages the rear surface of the panel. The opening in the panel may contain a notch, and the rear surface of the annular ridge 45 may contain a corresponding projection sized to fit into the notch on the panel. This arrangement prevents rotation of the molded housing 44 when the lock nut of the attaching male connector is assembled through the thread 52 on the front projection 44. This also enables a more coarse, more aggressive thread to be used on the forward extension 46 to achieve a better, water-tight seal with the O-ring 55. The front edge of the forward extension 46 may be chamfered as at 59 to facilitate attachment of the coupling nut 24.

In use, when the female connector body 35 is secured to a printed circuit board or other medium carrying leads 41, the male connector assembly shown in FIG. 4 may be attached to the housing 44 by first inserting the nose portion of the male connector 12 through the front aperture 48 and then into receptacle 36 of the female connector 32. Next, the coupling nut 24 is threaded onto the externally threaded extension 46 of the molded housing 44.

In summary, a more secure and mechanically stable connection is made, according to the present invention, while using conventional RJ45 male and female connectors which are widely used in the network communications industry, as described above. Thus, the overall assembly, through the present invention, is rendered suitable for use in a more rugged or industrial environment while maintaining reliability both mechanically and electrically.

Figure 14:
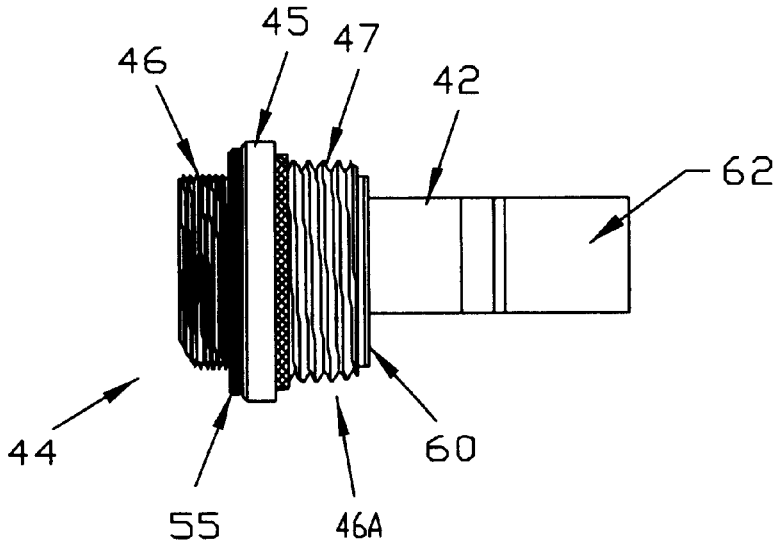
FIG. 14 is a top view of a pass-through panel mount assembly for an Ethernet or RJ45 connector.
Figure 15:
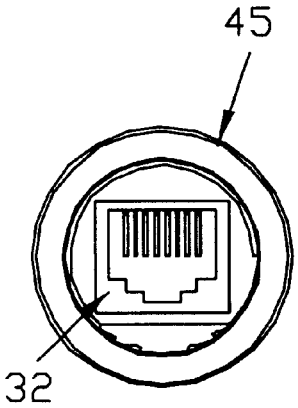
FIG. 15 is a front view of the panel mount assembly of FIG. 14.
Figure 16:
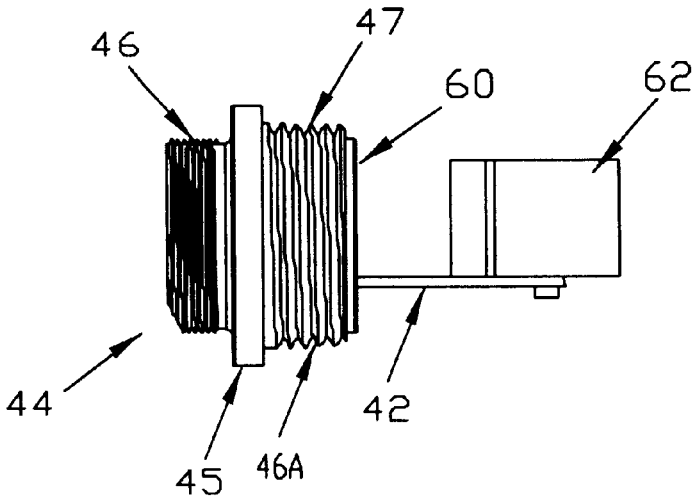
FIG. 16 is a side view of the panel mount assembly of FIG. 14.

Turning now to FIGS. 14–16, there is shown a modification of the panel-mounted female connector disclosed in FIGS. 10–13 which is referred to as a "pass through" connector. In the embodiment of FIGS. 14–16, those elements which are the same as elements already disclosed have been given the same reference numeral. Thus, a conventional female data signal connector 32 is mounted, as discussed, within a molded housing 44, including a forwardly extending externally threaded extension 46 adapted to receive the coupling nut of a mating male connector, and a rearwardly extending externally threaded rear extension 47. A printed circuit board 42 is mounted to the connector 32 and extends rearwardly of the molded housing 44, through a correspondingly dimensioned slot in a rear cover 60 which is welded or staked to the rear opening of the extension 46A. The cover 60 may have forwardly extending arms fitting into the ways 50 used to locate the female data signal connector. The arms secure the data signal connector in place. A second conventional female RJ45 connector shown at 62 in FIGS. 14 and 16 is then mounted on the printed circuit board 42, with its receptacle opening facing to the right in the drawing so that a second male connector may be attached to it.

Figure 17:
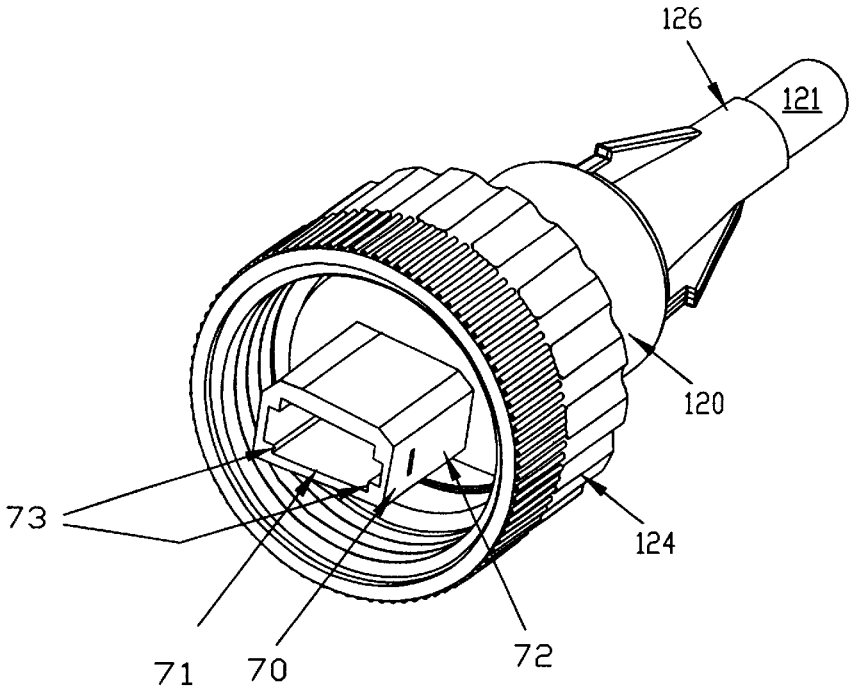
FIG. 17 is a perspective view of an industrial connector according to the present invention for a Universal Serial Bus data signal connector.
Figure 18:
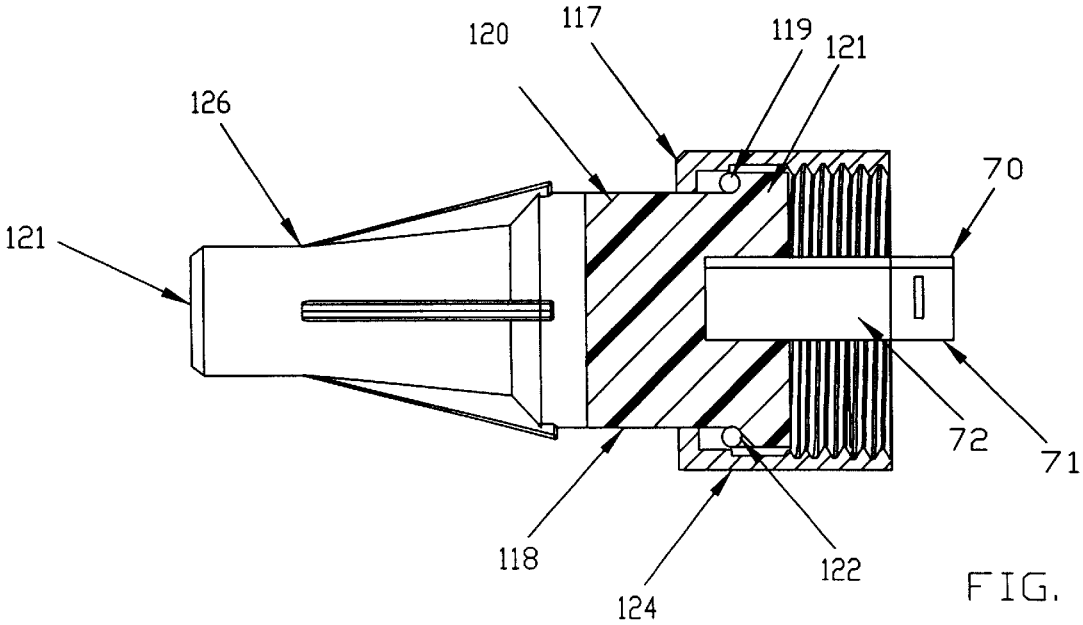
FIG. 18 is a side view of the assembly of FIG. 17 with the core mold and coupling nut in cross section.
Figure 19:
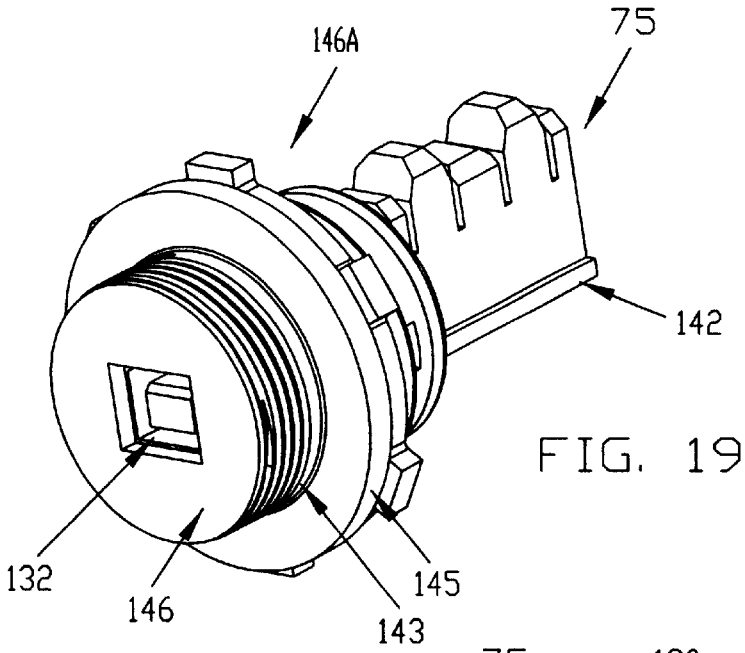
FIG. 19 is a perspective view of a female panel mount industrial connector for a Universal Serial Bus data signal connector.
Figure 20:
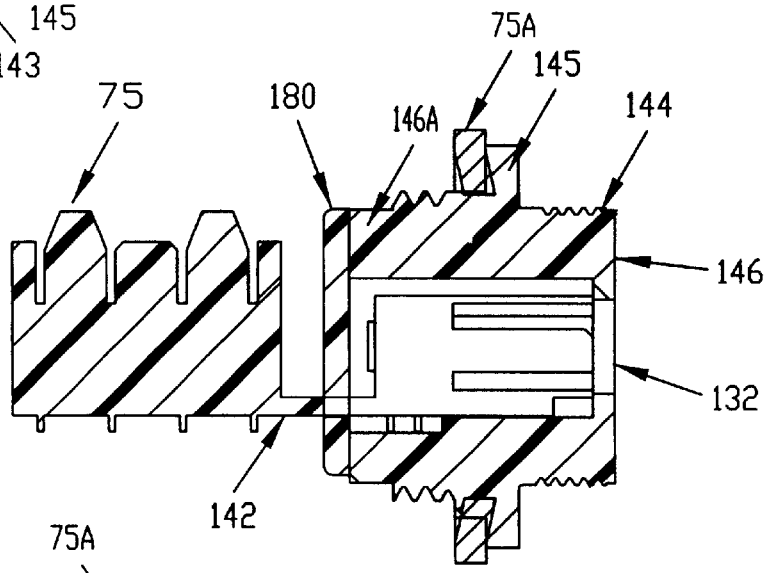
FIG. 20 is a vertical cross sectional view of the industrial connector of FIG. 19 looking from the left side of FIG. 19.
Figure 21:
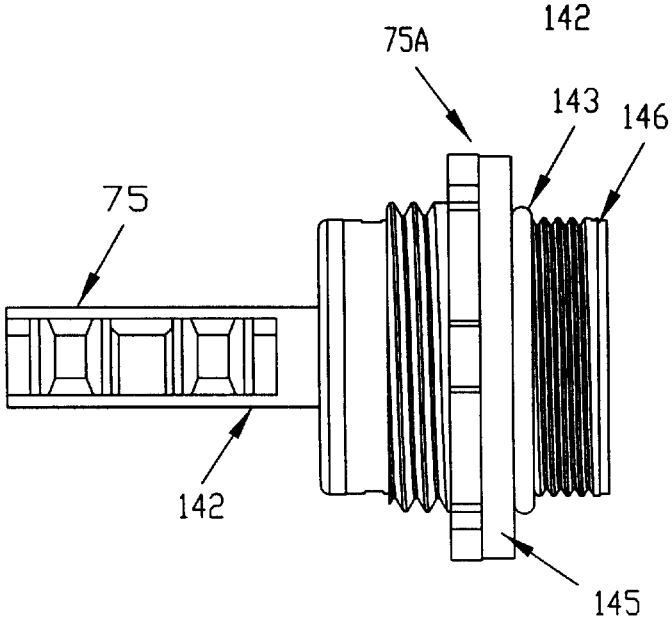
FIG. 21 is a plan view of the industrial connector assembly of FIG. 19.

Turning now to FIGS. 17–21, there is shown an alternate embodiment of the invention adapted to provide an industrial version of a conventional data signal connector known in the industry as the Universal Serial Bus (USB) connector. The male connector is shown in FIGS. 17 and 18 and the female connector, adapted to be panel mounted, is shown in FIGS. 19–21.

Elements or structure which are similar to that which has already been described will be given the same reference numeral preceded by a "1." Turning then to FIGS. 17 and 18, a conventional USB connector, which is considered a female connector, is generally designated by reference numeral 70. It is a data signal connector having four connector elements. The connector elements are located, two on either side of the bottom wall 71 of the housing 72, the two leads being designated 73 in FIG. 17. A core mold 120 of a rigid plastic such as ABS encompasses and secures the rear (left in FIG. 18) portion of the housing 72. The forward portion of the core mold 120 is enlarged slightly to form a cylindrical portion or collar 121, the rear portion of which defines a shoulder or peripheral wall 122. The cable 121, the leads of which are connected to the connecting elements of the USB connector 70, passes through the core mold 120 and the overmold 126 which may be substantially identical to the previously described overmold 26.

A coupling nut 124 is received over the cable, overmold 126, and the core mold 120. A sealing O-ring 119 is located on the rear cylindrical portion 118 of the core mold 120 and is adapted to form a seal between the shoulder 122 of the core mold and the annular rear wall 117 of the coupling nut 124. The rear end of the core mold is provided with a recess, similar to the previously described recess 25 for establishing a better mechanical attachment to the overmold 126.

Turning now to FIGS. 19–20, the female or panel-mounted industrial USB connector includes a conventional USB female connector having connecting elements for contacting in connecting to the corresponding male connecting elements 73. The female connector is mounted to a printed circuit board 142, to the rear of which is mounted a conventional insulation displacement connector 75.

The female USB connector 132 is housed within a molded housing 144 having a forward externally threaded extension or neck 146, a rear externally threaded extension 146A and a central peripheral flange 145. An O-ring 143 is received on the base of the forward extension 146, between the forward surface of the peripheral flange 145 and the threads on the extension 146.

A conventional electric mounting nut 77 is received on the threads of the rear extension 146A of the core molding for mounting the housing 144 to a wall, the wall being received between the rear surface of the flange 145 and the forward surface of the nut 75.

A closure member 180 is fixed to the rear wall of the rear extension 146A, either by chemical bonding or heat welding. The closure member 180 includes an aperture through which a printed circuit board 142 is extended between the connector 132 and the insulation displacement connector 75.

While particular embodiments of the present invention have been shown and described, it will be apparent to those skilled in the art that changes and modifications may be made without departing from the invention in its broader aspects. The matter set forth in the foregoing description and accompanying drawings is offered by way of illustration only and not as a limitation.

We claim:

1. An electrical assembly suitable for industrial use comprising:

an electrical data signal connector having a plurality of connecting elements and an outer casing;

a cable including a plurality of conductor wires and an outer sheathing, said connecting elements of said data signal connector being connected respectively to associated ones of said conducting wires of said cable;

a rigid core mold encompassing a portion of said casing and extending beyond said casing to define an interconnect structure surrounding said cable;

a strain-relieving flexible overmold surrounding said cable adjacent said interconnect structure of said core mold and contacting said core mold and coupling to said interconnect structure thereof;

a threaded coupling nut having a rear wall received on said core mold, said core mold defining a peripheral shoulder to limit the forward motion of said coupling nut, said coupling nut at least partially surrounding said data signal connector when engaging a mating electrical data signal connector; said rear wall of said coupling nut constructed and arranged to engage said stop of said core mold when coupling to a mating female connector; and a sealing O-ring on said core mold between said shoulder thereof and said rear wall of said coupling nut for establishing a watertight connection when said coupling nut is assembled to a mating connector assembly.

2. The apparatus of claim 1 wherein said data signal connector is male and further including a mating female electrical assembly suitable for industrial use and comprising a female electrical data signal connector adapted to be electrically coupled to said male electrical data signal connector; a rigid molded housing defining a passage extending therethrough, said female data signal connector mounted in said passage of said housing, said housing comprising a peripheral flange extending around an intermediate portion thereof, a first externally threaded extension extending forwardly of said flange and a second externally threaded extension extending rearwardly of said flange, said second extension adapted to be received in an aperture of a mounting panel; and a lock nut adapted for threaded engagement on said second extension.

3. The apparatus of claim 2 wherein passage provides a forward and a rear aperture, and further comprising a printed circuit board mounted to said female data signal connector and extending beyond a rear end of said molded housing, said female electrical assembly further comprising a closure member defining an aperture receiving said printed circuit board and mounted to said molding to close the rear aperture of said passage.

4. The apparatus of claim 3 wherein said female data signal connector has a locating ear on either side and said molded housing defines first and second ways respectively on opposing ways in said passage, said closure member including first and second forwardly extending arms received respectively in said first and second ways to secure said female data signal connector in said passage of said housing.

5. The apparatus of claim 1 wherein said male and female electrical data signal connectors are RJ45 connectors.

6. The apparatus of claim 1 wherein said core molding mold is made of a rigid plastic material.

7. The apparatus of claim 6 wherein said plastic material is ABS plastic.

8. The apparatus of claim 1 wherein said overmold is made of a flexible plastic material.

9. The apparatus of claim 8 wherein said plastic material for said overmold is polyurethane.

10. The apparatus of claim 8 wherein said overmold comprises a forward cylindrical portion abutting, overlapping and coupled to the rear portion of said core mold, at least one tapered intermediate section reducing in diameter from said core mold extending in a direction away from said connector; and a plurality of longitudinally extending ribs spaced angularly about said overmold from a location intermediate of said tapered section thereof to a forward location adjacent said forward cylindrical portion thereof.

11. The apparatus of claim 10 wherein said overmold further comprises a plurality of flexible projections adapted to permit said coupling nut to be received over said extensions and engaging said coupling nut and impeding any removal movement.

12. The apparatus of claim 1 wherein said electrical data signal connector is a male RJ45 connector.

13. The apparatus of claim 1 wherein said electrical data signal connector is a male Universal Serial Bus connector.

14. The apparatus of claim 1 wherein said male and female electrical data signal connectors are Universal Serial Bus connectors.

15. An electrical assembly suitable for industrial use comprising:

an electrical data signal connector having a plurality of connecting elements and an outer casing;

a cable including a plurality of conductor wires and an outer sheathing, said connecting elements of said-data signal connector being connected respectively to associated ones of said conducting wires of said cable;

a rigid core mold encompassing a portion of said casing and extending beyond said casing to define an interconnect structure surrounding said cable;

a strain-relieving flexible plastic overmold surrounding said cable adjacent said interconnect structure of said core mold and contacting said core mold and coupling to said interconnect structure thereof;

said overmold including a forward cylindrical portion abutting, overlapping and coupled to the rear portion of said core mold, at least one tapered intermediate section reducing in diameter from said core mold extending in a direction away from said connector, and a plurality of longitudinally extending ribs spaced angularly about said overmold from a location intermediate said tapered section thereof to a forward location adjacent said forward cylindrical portion thereof; and a coupling member received on said core mold, said core mold defining a stop to limit the forward motion of said coupling nut, said coupling member at least partially surrounding said data signal connector when engaging a mating electrical data signal connector.

16. The apparatus of claim 15 wherein said overmold further comprises a plurality of flexible projections adapted to permit said coupling nut to be received over said extensions and engaging said coupling nut and impeding any removal movement.

* * * * *